US005697321A

United States Patent [19]

Dobbins

[11] Patent Number: 5,697,321

[45] Date of Patent: Dec. 16, 1997

[54] FLAG-BANNER SUPPORT ASSEMBLY

[76] Inventor: John J. Dobbins, 721 Woodbine Rd., Huntsville, Ala. 35802

[21] Appl. No.: 739,935

[22] Filed: Oct. 30, 1996

Related U.S. Application Data

[63] Continuation of Ser. No. 394,583, Feb. 27, 1995, abandoned.

[51] Int. Cl.[6] ..... G09F 17/00

[52] U.S. Cl. ..... 116/174

[58] Field of Search ..... 116/173, 174, 116/175

[56] References Cited

U.S. PATENT DOCUMENTS

| | | | |
|---|---|---|---|
| 982,645 | 1/1911 | Suhr | 116/174 |
| 984,884 | 2/1911 | Blank | 116/173 |
| 1,311,712 | 7/1919 | Power | 116/174 |
| 1,337,237 | 4/1920 | Light | 116/173 |
| 1,855,824 | 4/1932 | Crichton | 116/173 |
| 2,794,414 | 6/1957 | Reifschneider | 116/173 |
| 3,587,520 | 6/1971 | Miller | 116/173 |
| 5,253,608 | 10/1993 | Burke | 116/173 |
| 5,255,627 | 10/1993 | Williams | 116/174 |
| 5,335,621 | 8/1994 | Willis et al. | 116/173 |

FOREIGN PATENT DOCUMENTS

| | | | |
|---|---|---|---|
| 63529 | 1/1892 | Germany | 116/174 |
| 621884 | 2/1981 | Switzerland | 116/173 |

*Primary Examiner*—William A. Cuchlinski, Jr.
*Assistant Examiner*—Willie Morris Worth
*Attorney, Agent, or Firm*—C. A. Phillips

[57] ABSTRACT

A flag or banner assembly wherein a flag or banner hangs from a generally horizontal staff and wherein an arm or rod extends downward from the staff and attaches to a lower region of the flag or banner wherein wrapping of the flag or banner around the staff is substantially reduced or prevented.

5 Claims, 2 Drawing Sheets

FLAG-BANNER SUPPORT ASSEMBLY

This application is a continuation of application Ser. No. 08/394,583, filed Feb. 27, 1995, abandoned.

FIELD OF THE INVENTION

This invention relates generally to a flag or banner supporting assembly and more particularly to an assembly for attachment to a flag wherein, for example, a flag is suspended from a generally horizontal or off-vertical mounted staff as opposed to one which is oriented in an essentially vertical direction.

BACKGROUND OF THE INVENTION

In many instances, it is desirable to effect a display of a flag or banner supported from other than a vertical support, and in such case, it has been found that there is a particular problem with winding of the flag or banner around its immediate support, generally termed a staff, such being caused by wind. The result is that thus the flag or banner is no longer adequately displayed.

PRIOR ART STATEMENT

It has been noted that U.S. Pat. Nos. 421,784; 4,332,210; 4,791,878; and 5,044,301 disclose flag staffs which are adapted to be positioned on a slope with respect to the vertical. However, it appears that none of these disclose a means of solving the problem referred to above.

It is the object of this solve such problem.

SUMMARY OF THE INVENTION

In accordance with the present invention, a flag staff supporting a flag or banner in an off-vertical orientation is equipped with an anti-winding assembly wherein the flag is prevented from rising above, and winding around, the flag staff. Thus, here the applicant provides the combination of a flag staff oriented at an off-vertical direction, a flag or banner hanging from it, and additionally, an arm assembly hangs from the staff beside one edge of the flag and attaching at a side or lower end region of the arm to the flag. The attachment is by an openable clamp. By this assembly, the arm, being one with a basically small cross section-to-length, ratio has little wind loading and has greater density than the flag. Thus, the arm assembly effectively biases the flag in a generally unfurled state by counteracting the wind loading on the flag itself.

DESCRIPTION OF THE PREFERRED EMBODIMENT

Figure 1:
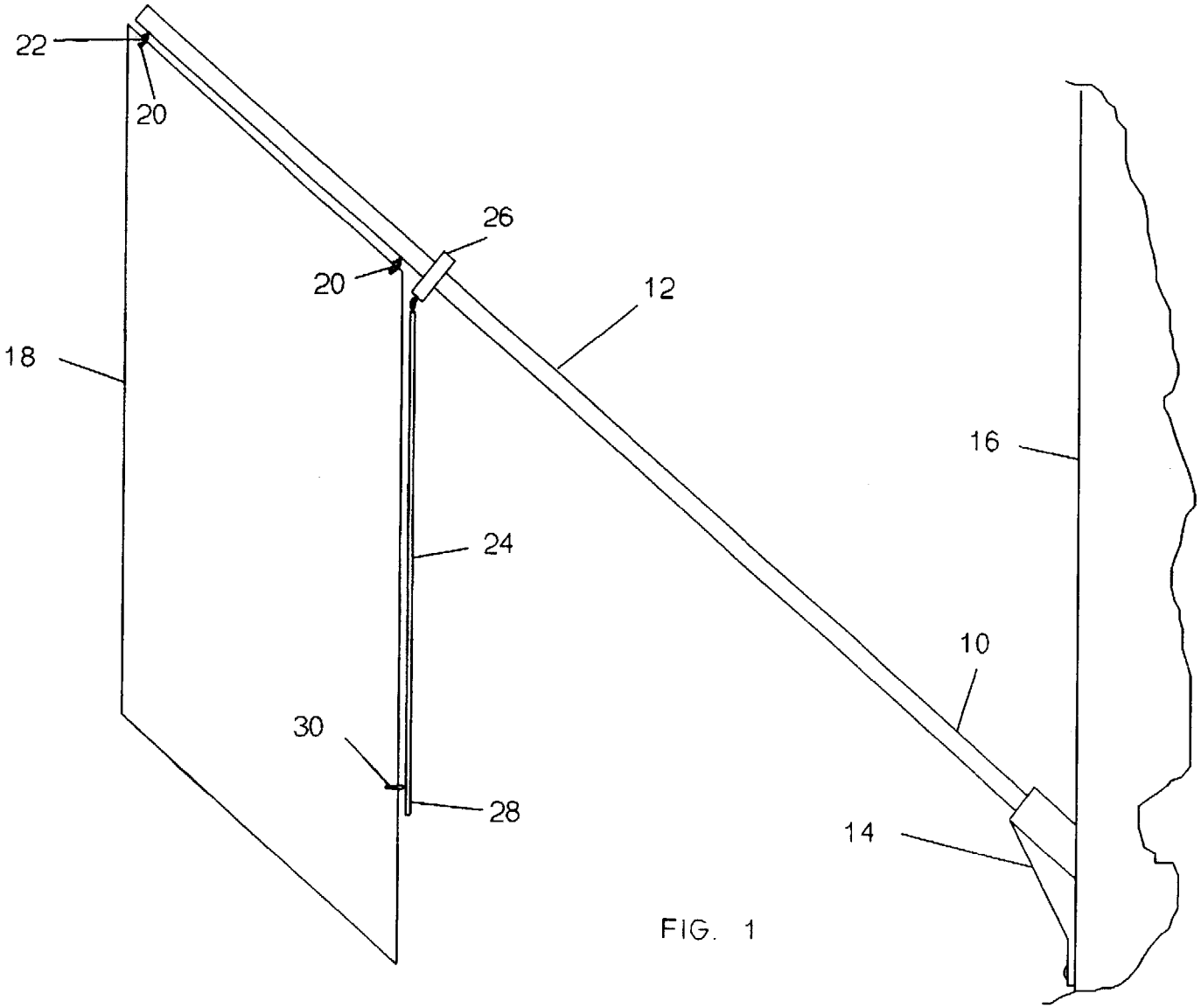
FIG. 1 is a side view of an embodiment of the invention.

Referring to the drawings, and particularly to FIG. 1, one end region 11 of staff 12 is supported by a receptacle 14, which in turn is attached to a wall 16 or other vertical support by means not shown.

Staff 12 is typically of a thickness and length to accommodate the particular flag (or banner) 10 to be supported, and it is typically at an upwardly extending angle on the order of 30°. Staff 12 is supported in a receptacle-type holder 14 which is mounted on a pole or building 16 by means not shown.

Figure 3:
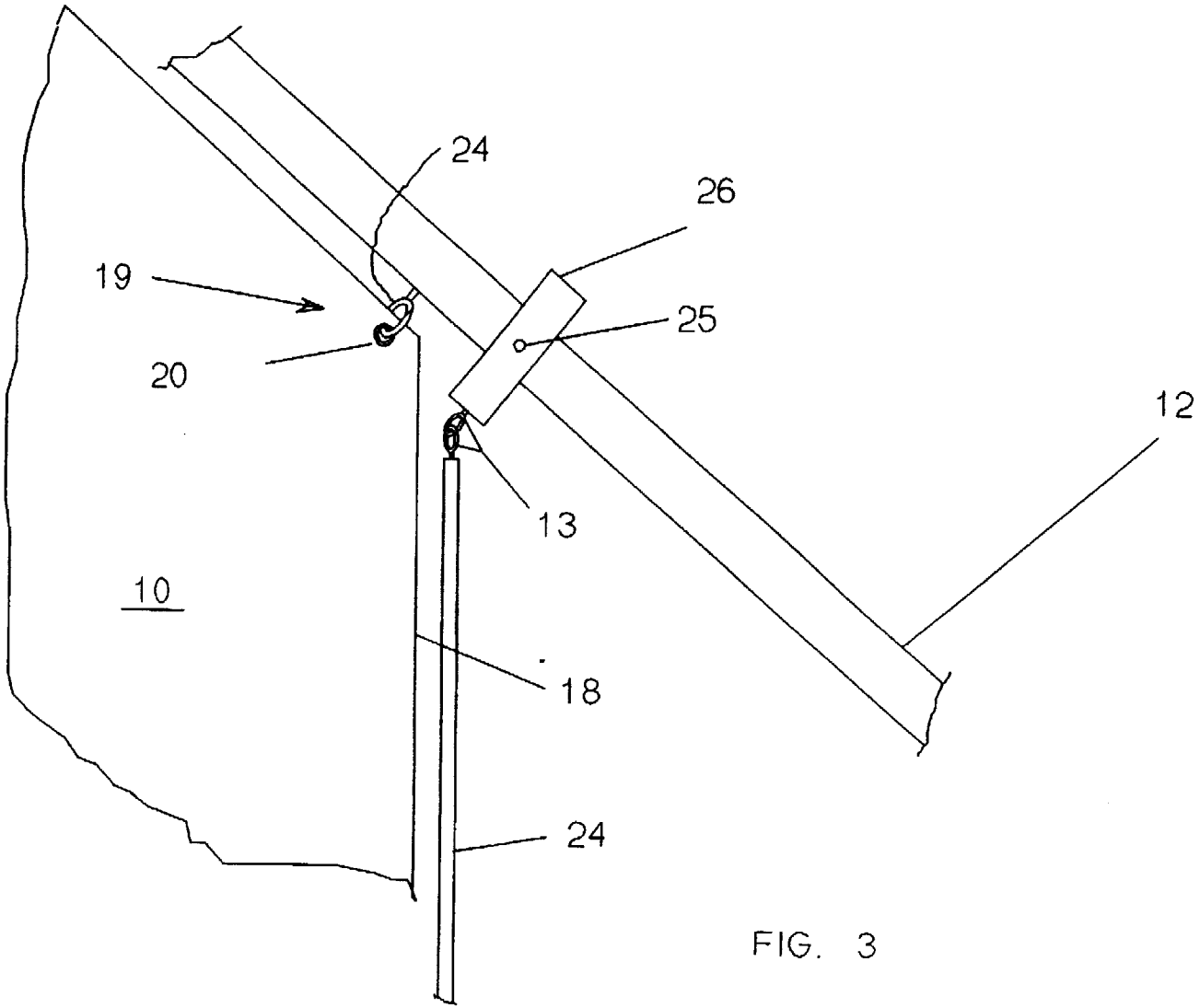
FIG. 3 is a detailed drawing illustrating the attachment of a flag or banner to a steadying arm.

Flag or banner 10 has two optimumly spaced like attachment assemblies 19 at its upper side, one of which is illustrated in detail in FIG. 3. As illustrated, each would employ a screw eye 24 screwed into staff 12, and the eye of the screw eye would pass through grommet 20 in flag 10. Screw eye 24 would typically include a small gap for flag installation or removal. Alternately, an intermediately positioned, convention split ring (not shown) would connect between grommet 20 and screw eye 24 to facilitate flag installation or removal.

Flag 10 thus freely suspends from staff 12, and as will be appreciated, it alone is quite likely to be blown by a breeze or wind and wrap around staff 12. Thus, the flag becomes partially or totally obscured.

In accordance with the present invention as shown in FIG. 1, an elongated rod 24 has at one end an attached ring 26, being attached as with two inter-linked screw-type eyes 13 (FIG. 3) attached to rod 24 and the other into ring 26. Ring 26 is of a size to fit over staff 12, and by means of set screw 25, it is attached to staff 12 as shown. This thus positions rod 24 as illustrated, and it suspends downward, vertically, ring 26 having been positioned to enable rod 24 to suspend along side 18 of flag 10.

Figure 2:
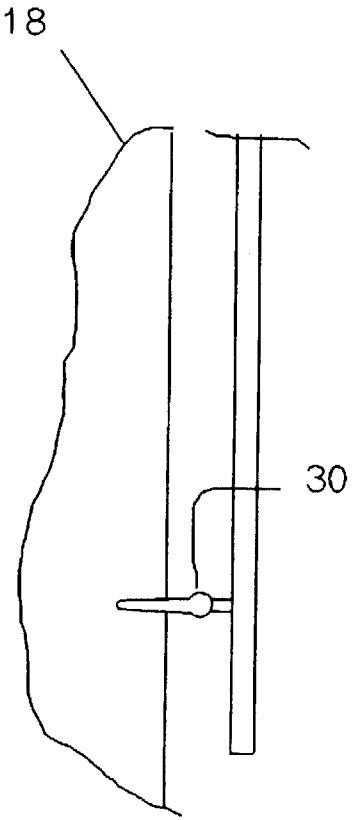
FIG. 2 is a detailed drawing illustrating clamping of the flag or banner.

A clasp or clamp 30 is attached to the lower end region 28 of rod 24 as particularly illustrated in FIG. 2. Thus, for example, clamp 30 would include, or there would be attached thereto, a screw 31, or other attachment, which would permanently attach clamp 30 to the lower region 28 of rod 24.

Clamp 30 has conventional adjustable jaws which may be clamped or unclamped to a generally lower region of flag 10 as illustrated in FIG. 1.

Rod 24 may be constructed of wood, metal, or plastic, the requirement being that it have such mass as would operate, in the configuration shown, to perform two functions. One function is to keep flag 10 from curling upward from the bottom and partially obscuring the flag, and two, preventing the flag from wrapping around staff 12. It typically would have a small cross section-to-length ratio

Having thus described my invention, what is claimed is:

1. A flag or banner assembly comprising:

a staff having first and second ends;

support means for supporting said staff at said first end and configured to effect a support of said staff in a direction having a significant horizontal component;

a flag or banner having a generally top side, a generally bottom side, and a pair of opposite sides generally normal to at least one of the other said sides;

attachment means for attaching said top side of said flag or banner to said staff wherein said flag or banner hangs generally unfurled from said staff;

an elongated rod having first and second opposite end regions and a discrete mass;

a coupling member attached to said first end region of said rod and configured to fixedly connect to a discrete length point on said staff and yet enabling said rod to freely hang vertically and along one of said opposite sides of said flag or banner; and a clamp member attached to said second end region of said rod and including an openable clasp configured to selectively grip or release a region of one of said opposite sides of said flag or banner wherein said flag or banner is held generally unfurled by virtue of the mass of said rod, causing it to generally hang downward;

wherein said flag or banner is held by said rod, and wrapping of said flag or banner around said staff is prevented.

2. A flag or banner assembly as set forth in claim 1 wherein said coupling member includes a ring for extending around said staff.

3. A flag or banner assembly as set forth in claim 2 wherein said elongated rod has a relatively small cross section-to-length ratio whereby its wind loading is low with respect to said flag or banner and of a mass which biases said flag or banner in a hanging direction and thus avoids said flag or banner from wrapping around said staff.

4. A flag or banner assembly as set forth in claim 3 wherein said rod is constructed of material substantially more dense than said flag or banner.

5. A flag or banner assembly as set forth in claim 1 wherein said coupling member comprises:

a ring sized to surround said staff and a set screw threaded through said ring for locking said ring to said staff; and flexible coupling means for connecting said ring and said rod.

* * * * *